US010506352B2

(12) United States Patent
Steffen et al.

(10) Patent No.: US 10,506,352 B2
(45) Date of Patent: Dec. 10, 2019

(54) MICROPHONE UNIT WITH A HOUSING AND HEARING AID HAVING THE MICROPHONE UNIT

(71) Applicant: SIVANTOS PTE. LTD, Singapore (SG)

(72) Inventors: Marco Steffen, Hiddenhausen (DE); Thomas Naether, Lemgo (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/881,254

(22) Filed: Jan. 26, 2018

(65) Prior Publication Data

US 2018/0220244 A1 Aug. 2, 2018

(30) Foreign Application Priority Data

Jan. 30, 2017 (DE) ..... 10 2017 201 465

(51) Int. Cl.

| | |
|---|---|
| ***H04R 25/00*** | (2006.01) |
| *H04R 19/00* | (2006.01) |
| *H04R 19/04* | (2006.01) |

(52) U.S. Cl.

CPC ..... *H04R 25/604* (2013.01); *H04R 25/602* (2013.01); *H04R 19/005* (2013.01); *H04R 19/04* (2013.01); *H04R 2201/02* (2013.01)

(58) Field of Classification Search

CPC ..... H04R 25/65; H04R 25/658; H04R 1/105; H04R 25/60; H04R 2225/021; H04R 1/1066

USPC ..... 381/322, 381, 382

See application file for complete search history.

(56) References Cited

U.S. PATENT DOCUMENTS

| | | | | |
|---|---|---|---|---|
| 6,292,572 | B1 * | 9/2001 | Yoest | H04R 25/456 181/130 |
| 7,254,247 | B2 * | 8/2007 | Kragelund | H04R 25/604 381/322 |
| 2009/0116669 | A1 | 5/2009 | Song | |
| 2009/0161886 | A1 | 6/2009 | Tanaka et al. | |
| 2012/0046780 | A1 | 2/2012 | Rothkopf et al. | |

FOREIGN PATENT DOCUMENTS

| | | | |
|---|---|---|---|
| DE | 29916871 | U1 | 3/2001 |
| DE | 60204241 | T2 | 1/2006 |

* cited by examiner

*Primary Examiner* — Alexander Jamal

(74) *Attorney, Agent, or Firm* — Laurence A. Greenberg; Werner H. Stemer; Ralph E. Locher

(57) ABSTRACT

A microphone unit includes a housing having a first main surface and a second main surface disposed opposite each other. The housing surrounds an inner chamber which includes a resonance chamber. The first main surface includes a concave indentation facing toward the inner chamber. A hearing aid, including a substantially cylindrical battery and a microphone unit is also provided.

8 Claims, 3 Drawing Sheets

MICROPHONE UNIT WITH A HOUSING AND HEARING AID HAVING THE MICROPHONE UNIT

CROSS-REFERENCE TO RELATED APPLICATION

This application claims the benefit, under 35 U.S.C. § 119, of German Patent Application DE 10 2017 201 465.2, filed Jan. 30, 2017; the prior application is herewith incorporated by reference in its entirety.

BACKGROUND OF THE INVENTION

Field of the Invention

The invention relates to a microphone unit with a housing which includes a first main surface and a second main surface disposed opposite each other. The housing surrounds an inner chamber including a resonance chamber. The invention also relates to a hearing aid having the microphone unit.

In a hearing aid, in particular an acoustic prosthesis, an ambient sound is usually converted by a microphone into an audio signal which is further processed in a signal processing unit and, in that case, is amplified in a frequency range-dependent manner in particular, and the resultant output signal is converted by a loudspeaker into an output sound signal. The output sound signal is then fed to the ear of a user of the hearing aid. Depending on the audiological and anatomical requirements of the user, and in order to design the individual hearing aid to be as inconspicuous as possible to third parties when worn on the ear, there are designs for hearing aids on the market, in the case of which at least one portion, when worn, lies in the cavum conchae or in the auditory canal of the user, such as, for example, the ITE design, the ITC design, or the CIC or IIC design ("in the ear," "in the canal," "completely in the canal," "invisible in the canal").

Due to the typical anatomical circumstances, narrow limits are placed on the possible dimensions of those individual designs. That sets high requirements for the development of the hearing aid as such and on the space-optimized development of the individual components. In addition to the components including the microphone, the signal processing unit, and the loudspeaker mentioned at the outset, it is also necessary to place in the hearing aid, at least, a battery for power supply and, at most, further components such as, for example, an antenna for external data transmission.

Microphones including a micro-electro-mechanical system (MEMS) are frequently utilized in hearing aids at this time. In such a MEMS microphone, the actual signal-generating components are installed, together with electronics components for preprocessing the generated signal, in a housing which has a sound inlet opening and the inner chamber of which therefore functions as a resonance chamber. In that case, the electronics components are often soldered together with the actual signal-generating components on a shared circuit board which also forms a cover surface or bottom surface of the housing. In particularly small designs for hearing aids, such as, for example, the IIC design, the dimensions, i.e., both the size as well as the shape of the hearing aid, are substantially established by way of the battery which, in order to ensure proper operation, cannot be arbitrarily reduced in size. The configuration of a MEMS microphone having dimensions which are customary in the market in the immediate proximity of such a battery leaves some leeway for optimization with respect to the final dimension of the hearing aid.

SUMMARY OF THE INVENTION

It is accordingly an object of the invention to provide a microphone unit with a housing and a hearing aid having the microphone unit, which overcome the hereinafore-mentioned disadvantages of the heretofore-known microphone units and hearing aids of this general type and in which the microphone unit can be installed in the hearing aid in the most space-saving manner possible.

With the foregoing and other objects in view there is provided, in accordance with the invention, a microphone unit, comprising a housing which includes a first main surface and a second main surface positioned opposite each other, the housing surrounds an inner chamber that includes a resonance chamber, and the first main surface includes a concave indentation facing toward the inner chamber.

Embodiments which are advantageous and, in part, are inventive per se, are the subject matter of the dependent claims and the description which follows.

The first main surface and the second main surface are each preferably delimited in this case by edge-like sections or by edges, which are rounded, if necessary, and against each of which one lateral face of the housing adjoins, wherein a radius of curvature of a rounding is negligible with respect to the dimension of the main surface. In particular, the first main surface and the second main surface are the largest outer surfaces of the housing in terms of surface area in this case. Preferably, the inner chamber is completely surrounded by the housing, except for a number of sound inlet openings, if necessary. The resonance chamber is formed, in particular, by the complete inner chamber minus components of the microphone unit which are installed, if necessary, in the inner chamber, or by a portion of the vacant inner chamber, when the inner chamber includes a suitable partition, for example. Preferably situated in the inner chamber is at least one signal-generating component which is constructed for converting a sound pressure-change and/or air pressure-change into an electrical signal. It is further preferred when, in addition, further electronics components for preprocessing an electrical signal, which has been generated in this way, are installed in the inner chamber, in particular for the purpose of preamplification and/or dynamic compression and/or analog-digital conversion, in order to output, through the microphone unit, an audio signal which can be preferably further processed and which reaches a certain minimum signal level, in particular.

The concave indentation toward the inner chamber can extend over the entire first main surface or only over a preferably substantial surface section, preferably over at least one half of a surface direction. The concave indentation can also be flat in sections of the surface in this case, in a manner comparable to that of a paravent. In this case, a concave indentation toward the inner chamber is understood to mean, in general, that a parametrizable quantity of paths exists, wherein, for each of the paths, the two end points lie in the inner chamber in the region of opposing ends, respectively, of the surface section of the first main surface pertaining to the concave indentation, and the path intersects the first main surface twice. In other words, due to the concave indentation, the housing has an enclosed volume that is smaller than the volume that a housing would have if the housing included a first main surface without any concave indentation at all. As compared to such a housing, in which all the paths, the end points of which lie in the inner chamber on the first main surface, therefore also extend entirely in the inner chamber, in the housing according to the invention including the concave indentation, a volume portion of the first main surface is "missing" in the region of this main surface.

The concave indentation can preferably be matched, in terms of the dimensions thereof, i.e., in particular, with respect to the degree of curvature and the penetration depth into the inner chamber, to the shape of another component of the higher-order device, in which the microphone unit is provided for installation, i.e., in particular, to a structural component in a hearing aid. As a result, the structural component extends into the concave indentation of the microphone unit, instead of the microphone unit having to be installed spaced further apart from the structural component due to the shape of the structural component. The higher-order device, i.e., in particular, a hearing aid, can therefore be made more compact than would be the case for an installation of a comparable microphone unit without the corresponding concave indentation.

Conveniently, the concave indentation extends toward the inner chamber across the entire length of the first main surface in this case. In other words, the entire main surface is therefore concave, i.e., curved or domed toward the inner chamber. The concave indentation is preferably implemented along the longer surface side in this case when the first main surface has a substantially rectangular top view. The indentation can be constructed, in this case, as a smooth curvature of the first main surface or can include individual flat surface sections. The concave indentation can be implemented in such a way that, in one surface direction, straight lines can each be placed into the first main surface and, therefore, the first main surface is neither curved nor indented in any other way along this surface direction. Alternatively, the concave indentation can also be implemented in such a way, in particular, that a surface normal exists with respect to each of the lateral faces of the housing, which intersects the indentation twice. An extension of the concave indentation along the entire length of the first main surface makes it possible to adapt the microphone unit completely, i.e., in terms of the entire dimension thereof, to another component of the higher-order device, whereby a particularly compact design is made possible.

For practical reasons, the second main surface includes a convex bulge. The convex bulge can extend over the entire second main surface or only over a preferably substantial surface section, preferably over at least one half of a surface direction. The convex bulge can also be flat in sections of the surface in this case, in a manner comparable to that of a paravent. In this case, a convex bulge is understood to mean, in general, that a parametrizable quantity of paths exists, wherein, for each of the paths, the two end points, each facing the inner chamber, lie on the surface section of the second main surface pertaining to the convex bulge, and the path extends completely through the inner chamber. In other words, due to the convex bulge, the housing has an enclosed volume that is greater than the volume that a housing would have if the housing included a first main surface without any convex bulge at all. As compared to such a housing, in the housing according to the invention including the convex bulge, a volume portion domed toward the outside, i.e., away from the inner chamber, is added to the first main surface in the region of this main surface.

In particular, the first main surface and the second main surface are situated locally parallel to each other, i.e., they have a constant separation from each other with respect to the local surface normal. This is the case, for example, in an embodiment of the first and the second main surfaces as jacket portions, in each case, of two coaxial cylinders. Such an embodiment is advantageous, in particular, when the structural component, which engages into the concave indentation of the microphone unit upon installation into the higher-order device, has rotational symmetry. Alternatively, the first main surface can be displaced in parallel to the second main surface. Such a spacing can be monitored in production without a considerable amount of extra effort, which limits the costs in the production process. A convex bulge on the second main surface ensures that, in addition to the engagement of the structural component into the concave indentation of the first main surface, the entire microphone unit can be adapted, in terms of the shape thereof, to the shape of the structural component, which allows for an even more compact design.

Advantageously, the second main surface includes a number of sound inlet openings. In this case, a sound inlet opening is understood to mean, in general, an opening which is suitable, due to the size and configuration thereof, for conducting sound waves, in particular sound waves in the human auditory spectrum, from outside the microphone unit into the inner chamber, and therefore adulteration effects such as, for example, absorption or diffraction with interferences, remain negligible in this case. For this purpose, the sound inlet opening or each sound inlet opening is preferably constructed as a single bore in the second main surface. In this case, yet another structure can be impressed upon the sound waves, in particular, on the sound path which has been predefined by the sound inlet opening, into the inner chamber of the housing, by using components which are situated within the housing. Ambient sound can reach the inner chamber of the microphone unit through a sound inlet opening in the second main surface and, in the inner chamber, can be converted into an electrical signal by using suitable signal-generating components. As a result, due to the protective effect of the housing for the signal-generating components, these components can be dimensioned to be particularly delicate, and therefore the microphone unit can be made to be particularly compact.

Preferably, the first main surface and/or the second main surface include a circuit board. In particular, this means that the first main surface and/or the second main surface of the housing are formed by the relevant circuit board itself. Alternatively, the housing can be constructed in such a way that the relevant circuit board is situated on a housing inner wall on the first main surface and/or the second main surface. Signal-generating components for generating an electrical signal from local differences in sound pressure or air pressure, in particular, are situated on the circuit board or on at least one circuit board and are preferably electrically contacted to the circuit board, for example through soldering. In the case that the first main surface includes a circuit board, the circuit board extends, in particular, along the convex bulge. For the case in which the second main surface includes a circuit board, the circuit board extends, in particular, along the convex indentation toward the inner chamber. In other words, the circuit board in both cases is not constructed to be flat over the entire surface thereof, but rather, at most, is flat and/or curved in sections of the surface. It is useful in this case if only one of the two main surfaces includes a circuit board, since, in this case, the respective other main surface can be cost-effectively integrally produced together with the lateral faces of the housing, for example in an injection molding process or by deep drawing. The circuit board can be utilized in this case for contacting the microphone unit, i.e., in particular for outputting an audio signal generated in the microphone unit, and for contacting electronic components situated within the housing.

It also proves to be advantageous for the microphone unit to include a micro-electro-mechanical system (MEMS) for generating an electrical signal from an ambient sound. Microphones which utilize a MEMS for signal generation can be constructed to be particularly compact due to the small dimensions of the MEMS. Due to the delicate structure thereof, a MEMS must be protected to a particular extent against environmental influences and against an unexpected mechanical action. The configuration within the housing and, preferably, the electrical contacting to a circuit board situated on one of the two main surfaces, for example through soldering, is particularly advantageous in this case. Due to the proposed convex indentation of the first main surface of the housing, the desired space advantages, which are usually to be achieved from the use of a MEMS microphone, can be further improved.

Preferably, a number of electronics components related to the preprocessing of a microphone signal are situated within the housing. In particular, at least one of the two main surfaces in this case includes a circuit board, on which the electronics components are contacted. The microphone signal is preferably generated in this case by at least one signal-generating component which is situated in the inner chamber, wherein at least one of the signal-generating components is preferably contacted to a circuit board which is situated on one of the two main surfaces. In this case, the microphone signal is understood to mean, in general, the primary electrical signal which is directly generated by using a signal-generating component from the sound pressure-differences or air pressure-differences existing in the inner chamber of the housing. This can take place, for example, through a MEMS. Since the amplitude of the microphone signal is very low due, not in the least, to the small dimensioning, in order to use the microphone signal outside of the microphone unit within the scope of the application in a higher-order device, such as, for example, in a hearing aid, it is typically necessary to carry out a preprocessing of the microphone signal, which is not negligible, for example by way of an amplification and/or a compression of the signal dynamics. In this case, it is advantageous to combine the electronics components utilized for preprocessing with the actual signal-generating components in the microphone unit, and therefore the microphone unit outputs an audio signal which is capable of being further processed within the scope of the higher-order device. Due to the configuration of the electronics components within the housing surrounding the resonance chamber, the electronics components are protected against external influences.

With the objects of the invention in view, there is concomitantly provided a hearing aid, comprising a substantially cylindrical battery and a microphone unit of the above-described type, wherein the concave indentation in the first main surface of the microphone unit is adapted to the radius of the battery in such a way that the microphone unit is situated along a section of the jacket portion of the battery. The advantages described for the microphone unit and for the refinements thereof can be similarly transferred to the hearing aid in this case. The battery can be combined, in this case, with further components, such as, for example, a voltage converter, to form a battery unit, in order to convert a supply voltage output by the battery to an operating voltage of the hearing aid, wherein the additional components of the battery unit are situated, in particular, on the end faces of the battery, and therefore the substantially cylindrical shape, which is predefined by the battery, is also retained for the battery unit.

Other features which are considered as characteristic for the invention are set forth in the appended claims.

Although the invention is illustrated and described herein as embodied in a microphone unit with a housing and a hearing aid having the microphone unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
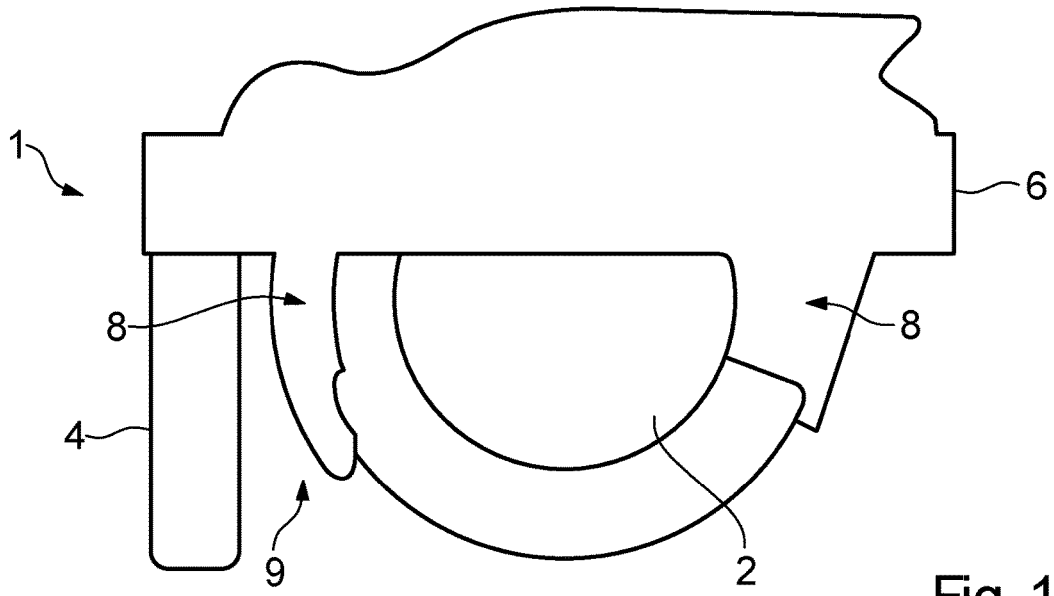
Fig. 1 (PRIOR ART)
FIG. 1 is a fragmentary, diagrammatic, top-plan view of a hearing aid including a battery unit and a microphone unit according to the prior art.

Referring now in detail to the figures of the drawings, in which parts and sizes that are the same are provided with the same reference signs, and first, particularly, to FIG. 1 thereof, there is seen a diagrammatic, top-plan view of a hearing aid 1 which includes a battery 2 and a microphone unit 4 according to the prior art. The hearing aid 1 in this case includes an outer housing 6 which is only partially illustrated, for the sake of better clarity. Clamps 8 for securing the battery 2 are formed into the outer housing 6. During operation of the hearing aid 1, the microphone unit 4, which is also situated in the outer housing 6, generates a microphone signal from an ambient sound. The microphone signal is further processed in the hearing aid 1 in a user-specific manner. Due to the cylindrical shape of the battery 2, the microphone unit 4 cannot be arbitrarily compactly mounted on the battery 2, so that the outer housing 6 becomes larger and voids 9, which are difficult to utilize, are formed in an inner chamber of the hearing aid 1. Even a configuration of the microphone unit 4 that is tilted tangentially with respect to the battery 2 would not change much in this case, and would only result in a structural complexity that is increased due to the tilting and, therefore, a more difficult attachment of the microphone unit 4.

Figure 2:
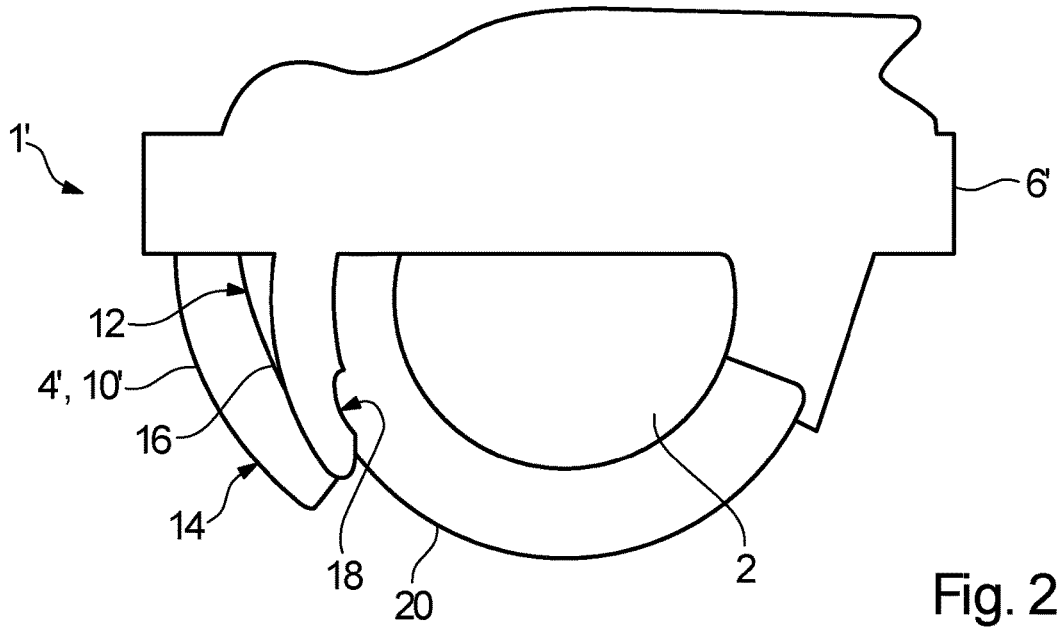
FIG. 2 is a fragmentary top-plan view of a hearing aid including a battery and a microphone unit, the main surfaces of which are curved along the battery.

FIG. 2 diagrammatically shows a top view of a hearing aid 1' including a battery 2 and a microphone unit 4' which has been partially adapted to the shape of the battery 2. Only a portion of an outer housing 6' of the hearing aid 1' is shown in this case as well, for the sake of better clarity. The microphone unit 4' includes a housing 10 having a first main surface 12 and a second main surface 14 positioned opposite the first main surface 12. The first main surface 12 is concavely indented toward the interior of the microphone unit 4', and the second main surface 14 is convexly bulged outward. The battery 2 can now engage into a concave indentation 16 of the first main surface 12, which has been formed in this manner, in such a way that the microphone unit 4' can be situated in the region of the clamps 8 along a section 18 of a jacket portion 20 of the battery 2.

Figure 3:
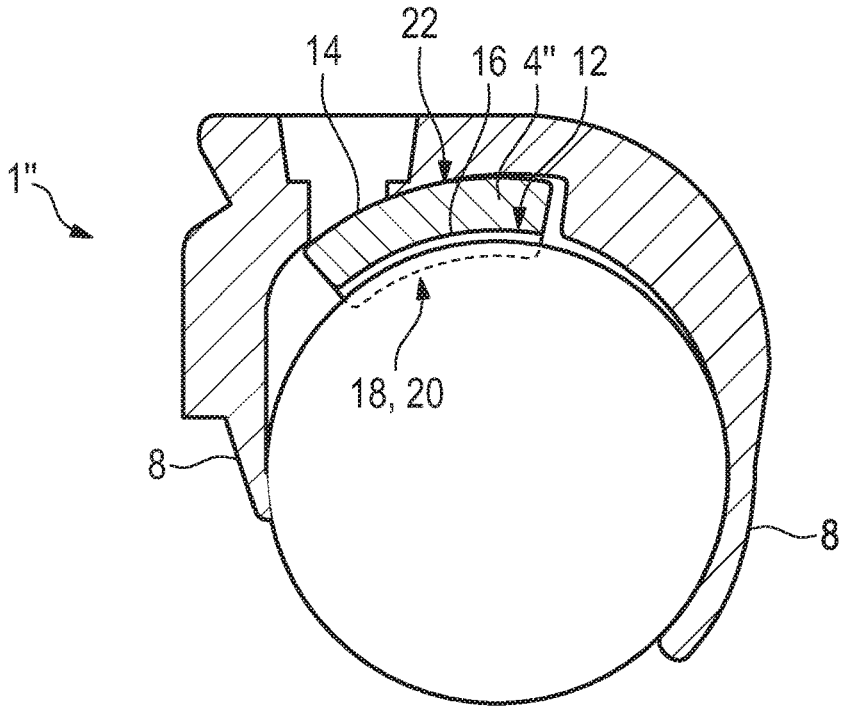
FIG. 3 is a cross-sectional view of a hearing aid including an alternative embodiment of a curved microphone unit.

FIG. 3 diagrammatically shows a cross-sectional representation of a hearing aid 1" including a variant of a microphone unit 4" which is an alternative to the embodiment represented in FIG. 2. In this case, the microphone unit 4" is not situated in the region of one of the clamps 8, but rather directly on the battery 2, so that, due to the concave indentation 16 of the first main surface 12 of the microphone unit 4", the microphone unit extends along the jacket portion 20 for the section 18. The curvature of the concave indentation 16 is adapted to the radius of the battery 2 in this case. The second main surface 14 of the microphone unit 4" includes a convex bulge 22 which corresponds to the concave indentation 16 of the first main surface 12 and is likewise adapted to the radius of the battery 2.

Figure 4:
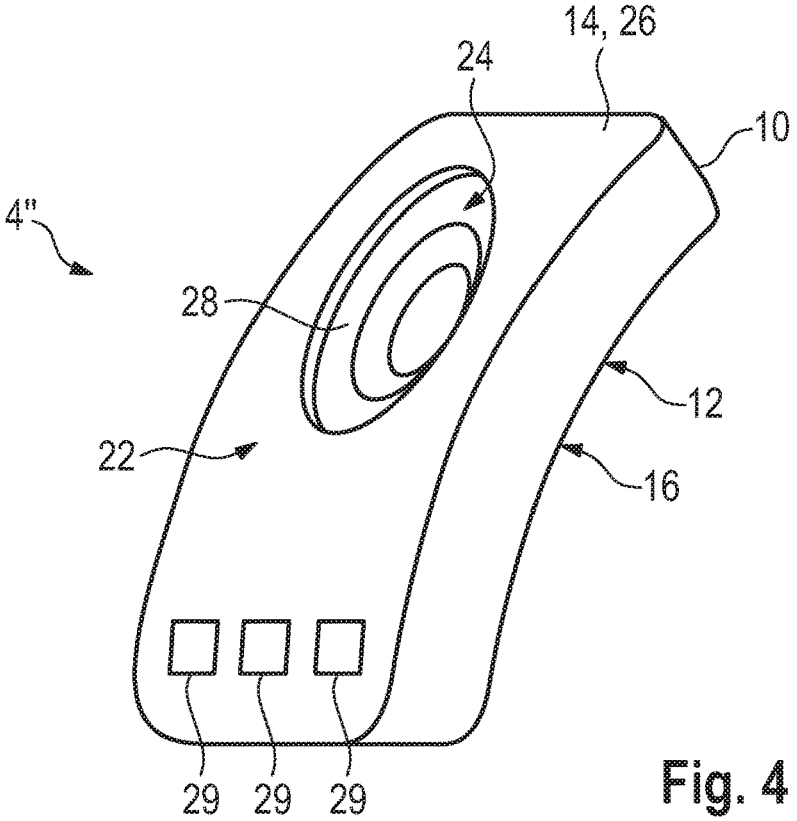
FIG. 4 is a perspective view of the microphone unit according to FIG. 3.

FIG. 4 shows an oblique view of the microphone unit 4" according to FIG. 3. The microphone unit 4" is surrounded by a housing 10 including a first main surface 12 and a second main surface 14 positioned opposite the first main surface 12. The first main surface 12 forms a concave indentation 16 toward an inner chamber surrounded by the housing 10, and the second main surface 14 forms a convex bulge 22 corresponding to the concave indentation 16. A sound inlet opening 24 is formed in the second main surface 14. An ambient sound can reach through the sound inlet opening 24 to the inner chamber surrounded by the housing 10, where an electrical signal is generated from the ambient sound by signal-generating components which are not represented in greater detail in FIG. 4. The second main surface 14 is formed in this case by a circuit board 26 which is provided with the sound inlet opening 24. An acoustic horn 28 is situated on the circuit board 26, on the sound inlet opening 24 toward the inner chamber, in order to improve sound conduction into the inner chamber of the microphone unit 4" and for avoiding diffractions and interferences. In addition, contact electrodes 29 are situated on the circuit board 26. The microphone unit 4" outputs a microphone signal through the contact electrodes 29 to the hearing aid 1" and, optionally, the contact electrodes 29 are used for supplying power to active components in the microphone unit 4".

Figure 5:
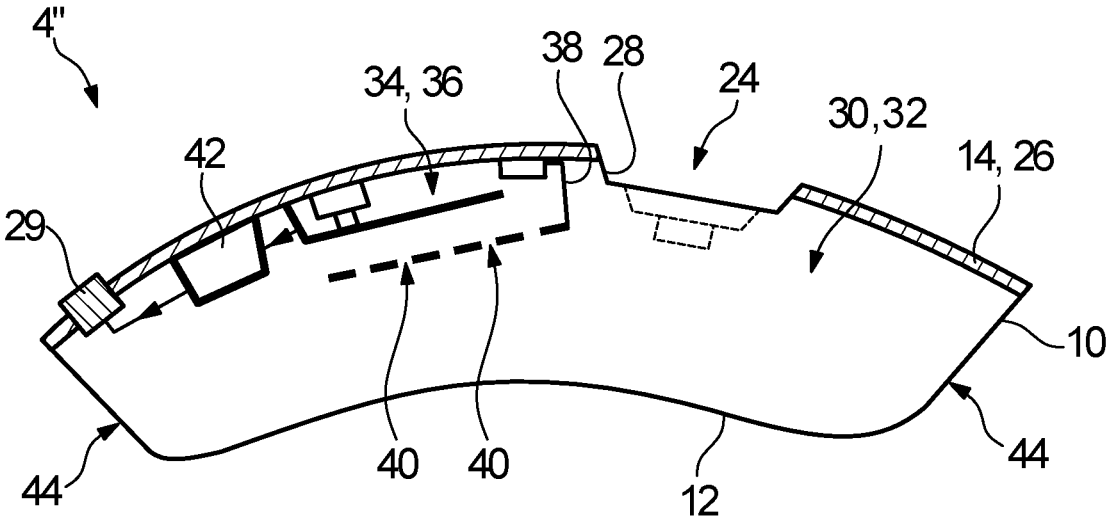
FIG. 5 is a longitudinal-sectional view of the microphone unit according to FIG. 3.

FIG. 5 shows a longitudinal-sectional representation of the microphone unit 4" according to FIG. 3. The housing 10 surrounds an inner chamber 30. An ambient sound can be conducted into the inner chamber 30 through the sound inlet opening 24, along the acoustic horn 28 situated on the circuit board 26 which forms the second main surface 14. The inner chamber 30 is used in this case as a resonance chamber 32 for the ambient sound. A MEMS microphone 34, which is soldered to the circuit board 26, includes a MEMS membrane 36. The MEMS membrane 36 together with an electrode 38 soldered on the circuit board 26, in principle forms a capacitor microphone. The electrode 38 is provided with sound holes 40 in order to improve sound transmission with respect to the resonance chamber 32. The electrical signal generated at the MEMS microphone 34 is now fed to a preliminary stage 42 which preprocesses the electrical signal, in particular by using a preamplifier, a dynamic compressor, and an A/D converter, and provides the preprocessed signal to the hearing aid, through the contact electrodes 29, for further processing. The concavely indented, first main surface 12 can be produced, in this case, together with lateral faces 44 of the housing 10, in a shared production process, for example by using injection molding or deep drawing, which simplifies production and reduces costs.

Although the invention was illustrated and described in greater detail by using the preferred exemplary embodiment, the invention is not restricted by this exemplary embodiment. Other variations can be derived therefrom by a person skilled in the art, without departing from the scope of protection of the invention.

The following is a summary list of reference numerals and the corresponding structure used in the above description of the invention. List of reference signs:

1 hearing aid
1', 1" hearing aid
2 battery
4 microphone unit (according to the prior art)
4', 4" microphone unit
5 outer housing
6', 6" outer housing
8 clamps
9 voids
10 housing
12 first main surface
14 second main surface
16 concave indentation
18 section
20 jacket portion
22 convex bulge
24 sound inlet opening
26 circuit board
28 acoustic horn
29 contact electrode
30 inner chamber
32 resonance chamber
34 MEMS microphone
36 MEMS membrane
38 electrode
40 sound holes
42 preliminary stage
44 lateral faces

The invention claimed is:

1. A microphone unit, comprising:
an inner chamber including a resonance chamber;
a housing surrounding said inner chamber;
said housing including a first main surface and a second main surface disposed opposite each other; and
said first main surface including a concave indentation penetrating into said inner chamber.

2. The microphone unit according to claim 1, wherein said concave indentation extends toward said inner chamber across an entire length of said first main surface.

3. The microphone unit according to claim 1, wherein said second main surface includes a convex bulge.

4. The microphone unit according to claim 1, wherein said second main surface has a plurality of sound inlet openings.

5. The microphone unit according to claim 1, wherein at least one of said first main surface or said second main surface includes a circuit board.

6. The microphone unit according to claim 1, which further comprises a micro-electro-mechanical system for generating a microphone signal from an ambient sound.

7. The microphone unit according to claim 1, which further comprises a plurality of electronics components disposed within said housing and related to preprocessing of a microphone signal.

8. A hearing aid, comprising:

a substantially cylindrical battery having a radius and jacket portion with a section; and a microphone unit according to claim 1, said concave indentation of said first main surface of said microphone unit being adapted to said radius of said battery permitting said microphone unit to be situated along said section of said jacket portion of said battery.

* * * * *